US007494398B2

(12) United States Patent
Laurienzo

(10) Patent No.: US 7,494,398 B2
(45) Date of Patent: Feb. 24, 2009

(54) REMOTELY CONTROLLED VEHICLE WITH DETACHABLY ATTACHABLE WHEELS

(75) Inventor: Dominic Laurienzo, Los Angeles, CA (US)

(73) Assignee: Jakks Pacific, Inc., Malibu, CA (US)

( * ) Notice: Subject to any disclaimer, the term of this patent is extended or adjusted under 35 U.S.C. 154(b) by 105 days.

(21) Appl. No.: 11/181,698

(22) Filed: Jul. 13, 2005

(65) Prior Publication Data

US 2006/0046612 A1 Mar. 2, 2006

Related U.S. Application Data

(60) Provisional application No. 60/604,283, filed on Aug. 25, 2004.

(51) Int. Cl.
*A63H 30/00* (2006.01)

(52) U.S. Cl. ..... 446/454; 446/456; 446/471; 446/465

(58) Field of Classification Search ..... 446/431, 446/457, 456, 454, 437, 460, 462, 465, 468, 446/469, 471
See application file for complete search history.

(56) References Cited

U.S. PATENT DOCUMENTS 3,733,739 A 5/1973 Terzian
3,742,507 A * 6/1973 Pirre ..... 446/454
3,748,780 A 7/1973 Glass et al.
4,193,597 A * 3/1980 Ogawa ..... 446/4
4,299,301 A 11/1981 Janin
4,547,166 A 10/1985 Goldfarb et al.
4,693,696 A 9/1987 Buck
4,696,655 A 9/1987 D'Andrade et al.
4,717,367 A * 1/1988 Stubenfoll et al. ..... 446/437
4,732,569 A * 3/1988 Hippely et al. ..... 446/430
4,832,651 A 5/1989 Buck
5,322,469 A 6/1994 Tilbor
5,338,247 A 8/1994 Miles
5,380,231 A * 1/1995 Brovelli ..... 446/6
5,643,036 A * 7/1997 Liu et al. ..... 446/23
5,643,041 A 7/1997 Mukaida
5,667,420 A 9/1997 Menow et al.
5,667,421 A 9/1997 Uetake (Continued)

FOREIGN PATENT DOCUMENTS

WO WO 00/07681 2/2000

*Primary Examiner*—Gene Kim
*Assistant Examiner*—Urszula M Cegielnik
(74) *Attorney, Agent, or Firm*—Tope-McKay & Associates

(57) ABSTRACT

A dual-wheel remotely controlled (RC) vehicle with two independently-controlled detachably attachable wheels is described. The RC vehicle comprises a body member having a right wheel and left wheel rotationally mounted proximate the body member. Each of the right and left wheels are drivably coupled with their own motors, such that each of the right and left wheels are independently controlled. Additionally, a quick release apparatus is included to provide for quick release of the wheels. Through use of the quick release apparatus, the wheels are interchangeable wheels and may be easily replaced with other interchangeable wheels. Furthermore, a stabilization apparatus is attached with the body member such that when the wheels are engaged, the stabilization apparatus is forced against a supporting surface, thereby preventing the body member from continuously spinning in place. Additionally, the detachably attachable wheels are formed to be used with devices other than a remotely controlled vehicle.

25 Claims, 16 Drawing Sheets

U.S. PATENT DOCUMENTS 5,752,871 A * 5/1998 Tsuzuki ..... 446/457
5,803,790 A 9/1998 Tilbor et al.
5,860,846 A 1/1999 Uetake
5,919,075 A 7/1999 George et al.
5,921,843 A 7/1999 Skrivan et al.
5,951,363 A 9/1999 Uetake
6,193,582 B1 2/2001 Gleim
6,227,934 B1 5/2001 Isaksson et al.
6,439,948 B1 * 8/2002 Ostendorff et al. ..... 446/154
6,475,059 B1 11/2002 Lee
6,648,722 B2 11/2003 Lynders et al.
6,764,374 B2 7/2004 Tilbor et al.
6,939,197 B1 9/2005 Hoeting
7,033,241 B2 * 4/2006 Lee et al. ..... 446/456

* cited by examiner

100

REMOTELY CONTROLLED VEHICLE WITH DETACHABLY ATTACHABLE WHEELS

PRIORITY CLAIM

This application is a non-provisional application, claiming the benefit of priority to provisional application No. 60/604,283, filed in the United States on Aug. 25, 2004, titled, "Wheel Spinning Launcher and Wheel Toy."

BACKGROUND OF THE INVENTION (1) Field of Invention

The present invention relates to a remotely controlled vehicle and, more particularly, to a remotely controlled vehicle having only two drive wheels, each of which are detachably attachable and are independently controlled.

(2) Description of Related Art

Remotely controlled (RC) vehicles have long been known in the art. RC vehicles typically include four wheels, with the front two being devoted to steering, while the rear two are attached to a drive train for propulsion. In production, a problem associated with creating a RC vehicle with four wheels is the additional costs of a servo mechanism to control the steering, and the additional costs of four as opposed to two wheels.

Furthermore, when turning an RC vehicle that includes four wheels, the vehicle cannot turn on the spot. In other words, the turning radius for a four-wheeled RC vehicle requires that the RC vehicle travel either forward or backward in an arc. Because of this constraint, four-wheeled RC vehicles cannot spin in place or make extremely tight turns, and instead, must often make a several point turn.

Additionally, the wheels are typically permanently affixed with the body of the RC vehicle. In circumstances where the wheels are not permanently affixed, the wheels are held on by bolts or nuts, requiring the use of tools to remove the wheel. Should a prior art RC vehicle be used in a terrain where a different type of wheel would be advantageous, either the wheel cannot be changed, or changing the wheels requires considerable time and effort.

Thus, a continuing need exists for a RC vehicle that saves production costs by operating with only two drive wheels and without a steering servo, that can make extremely tight turns, and that includes quick-release interchangeable wheels to provide for ease of changing the vehicles wheels.

SUMMARY OF INVENTION

The present invention relates to a remotely controlled (RC) vehicle. The RC vehicle comprises a body member having a left portion, a right portion, a top portion, a bottom portion, a front portion, and a rear portion.

A detachably attachable right wheel is rotationally mounted proximate the right portion of the body member for rotationally supporting the body member on a supporting surface. The right wheel has dimensions and a peripheral portion such that the peripheral portion of the right wheel extends beyond the top, bottom, and front portions of the body member. Additionally, a first motor is drivably coupled with the right wheel.

A detachably attachable left wheel is rotationally mounted proximate the left portion of the body member for rotationally supporting the body member on the supporting surface. The left wheel has dimensions and a peripheral portion such that the peripheral portion of the left wheel extends beyond the top, bottom, and front portions of the body member. A second motor is drivably coupled with the left wheel.

A receiver is attached with the body member for receiving control signals from a remotely controlled transmitter. The receiver is independently connected with both the first and second motors such that a control signal from the remotely controlled transmitter provides for independent control of each of the first and second motors and their respective right and left wheels.

A stabilization apparatus is attached with the body member such that when the wheels are engaged, the stabilization apparatus is forced against the supporting surface, thereby preventing the body member from continuously spinning in place.

Through use of a remotely controlled transmitter, a user can independently control each of the right and left wheels, such that uni-engagement of the left or right wheels alone causes the remotely controlled vehicle to turn, and bi-engagement of both the right and left wheels in opposite directions also causes the remotely controlled vehicle to turn, while bi-engagement in the same direction causes the remotely controlled vehicle to propel itself forward, thereby allowing a user to maneuver the remotely controlled vehicle in forward, reverse, left, and right directions.

In another aspect, the wheels are detachably attachable with the body member through the use of a quick release apparatus, such that actuation of the quick release apparatus releases at least one wheel, thereby allowing for placement of another interchangeable wheel.

Furthermore, both the first and second motors are encased within the body member.

In another aspect, the body member is formed such that it is water resistant, thereby protecting the remotely controlled vehicle from aqueous elements.

In another aspect, the present invention further comprises a remotely controlled transmitter configured to transmit control signals to the receiver. The remotely controlled transmitter includes a first controller and a second controller, where the first controller is configured to control the first motor and its corresponding right wheel, and where the second controller is configured to control the second motor and its corresponding left wheel.

In another aspect, the stabilization apparatus includes a rod connected with the body member, the rod having an outer portion and at least two stabilization wheels rotationally attached with the outer portion, such that in operation, the remotely controlled vehicle rests upon the left wheel, right wheel, and stabilization wheels.

In another aspect, the rod is in a movable connection with the body member.

In yet another aspect, the present invention further comprises an antenna circumferentially disposed around the rod.

In yet another aspect, the antenna is formed to operate as a spring to force the stabilization wheel away from the body member, thereby minimizing impact forces against the body member when coming in contact with a surface.

Additionally, in the movable connection, the body member includes at least one sleeve, with the rod inserted within sleeve, thereby providing for a slide-able rod inserted within the body member and creating the movable connection.

In yet another aspect, the stabilization apparatus is attached proximate the rear edge of the body member.

Additionally, each detachably attachable wheel includes a central rotor.

In yet another aspect, the stabilization apparatus includes a roller ball encased within the stabilization apparatus such that outer portions of the roller ball extend beyond the stabilization apparatus.

In another aspect, the detachably attachable wheel is formed to be used with a device other than a remotely controlled vehicle.

In yet another aspect, the device other than a remotely controlled vehicle is a launcher for launching the detachably attachable wheel.

Finally, as can be appreciated by one skilled in the art, the present invention also comprises a method for forming the RC vehicle described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1:
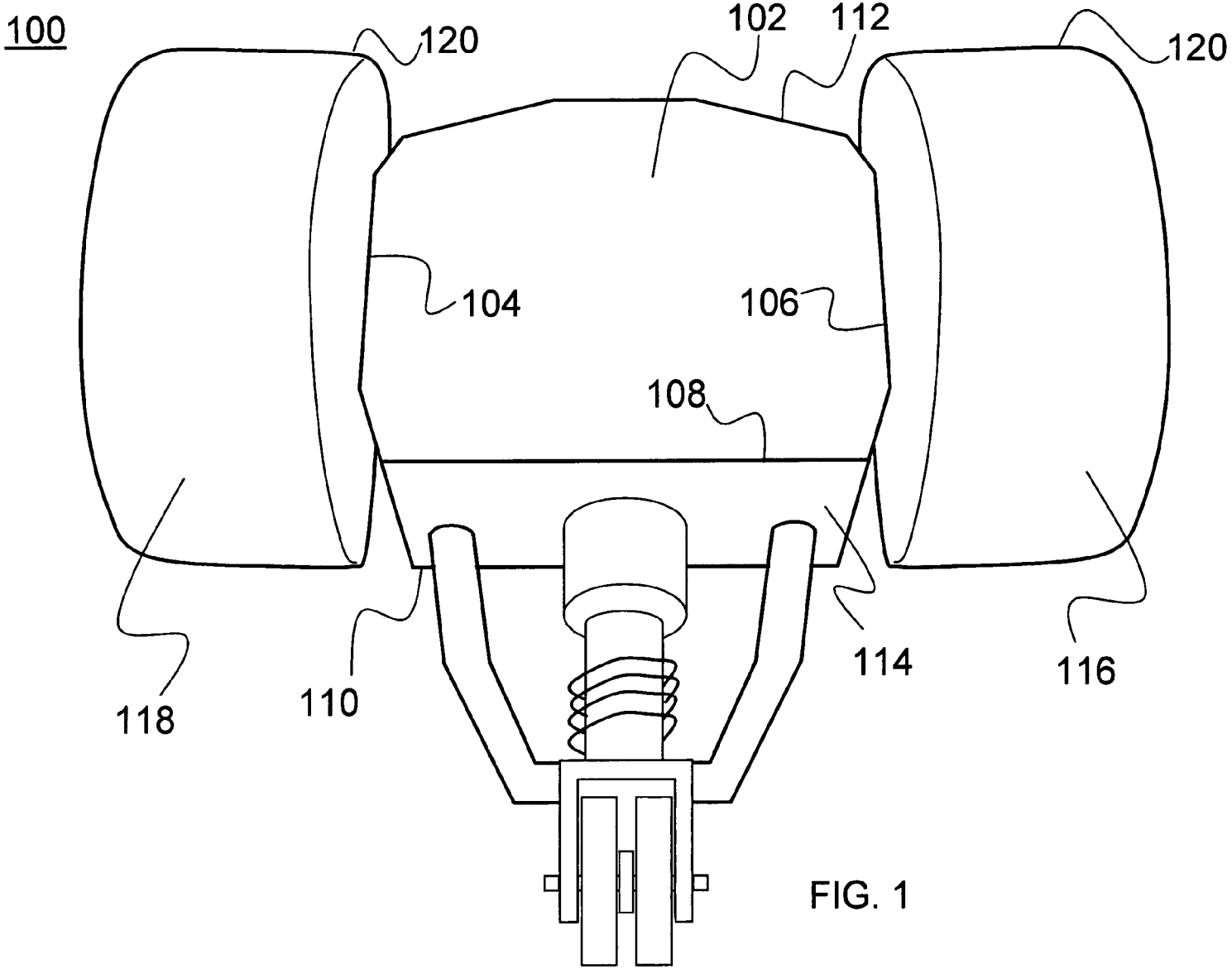
FIG. 1 is a top-view illustration of a remotely controlled vehicle according to the present invention.

The present invention relates to a remotely controlled vehicle, and more particularly to a remotely controlled vehicle having only two drive wheels, each of which are interchangeable and are independently controlled. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Note, the labels left, right, front, back, top, bottom, forward, reverse, clockwise and counter-clockwise have been used for convenience only and are not intended to imply any particular fixed direction. Instead, they are used to reflect relative locations and/or directions between various portions of an object. As such, as the remotely controlled vehicle is turned around and/or over, the above labels may change their relative configurations.

Before describing the invention in detail, an introduction is provided to provide the reader with a general understanding of the present invention. Next, a description of various aspects of the present invention is provided to give an understanding of the specific details.

(1) Introduction

The present invention relates to a remotely controlled vehicle and a launcher, both configured to operate with a detachably attachable wheel. The remotely controlled vehicle includes two, independently-controlled drive wheels, each of which are detachably attachable. The detachably attachable wheels can also be utilized with other devices such as a launcher. The launcher allows a user to attach the wheel with the launcher and thereby launch the detachably attachable wheel. For clarity purposes, the present invention will be described in two sections, the first describing various aspect of the remotely controlled vehicle with the second describing the launcher.

(2.1) Detailed Description of the Remote Controlled Vehicle

The present invention relates to a remotely controlled vehicle. FIG. 1 illustrates a top-view of the remotely controlled (RC) vehicle 100 according to the present invention. The RC vehicle 100 includes a body member 102 formed in a suitable shape for encasing various components therein. As a non-limiting example, the body member 102 has a left portion 104, a right portion 106, a top portion 108, a bottom portion 110, a front portion 112, and a rear portion 114. Additionally, the body member 102 is constructed of any suitably durable material, a non-limiting example of which includes plastic. Furthermore, the body member 102 is formed such that it is water resistant, thereby protecting the RC vehicle 100 and its encased contents from aqueous elements.

A detachably attachable right wheel 116 is rotationally mounted proximate the right portion 106 of the body member 102, while a detachably attachable left wheel 118 is rotationally mounted proximate the left portion 104 of the body member 102. Both the right wheel 116 and the left wheel 118 are attached for rotationally supporting the body member 102 when the RC vehicle 100 is placed upon a supporting surface. The body member 102 is formed such that the peripheral portions 120 of the right wheel 116 and left wheel 118 extend beyond the top 108, bottom 110, and front 112 portions of the body member 102.

Figure 2:
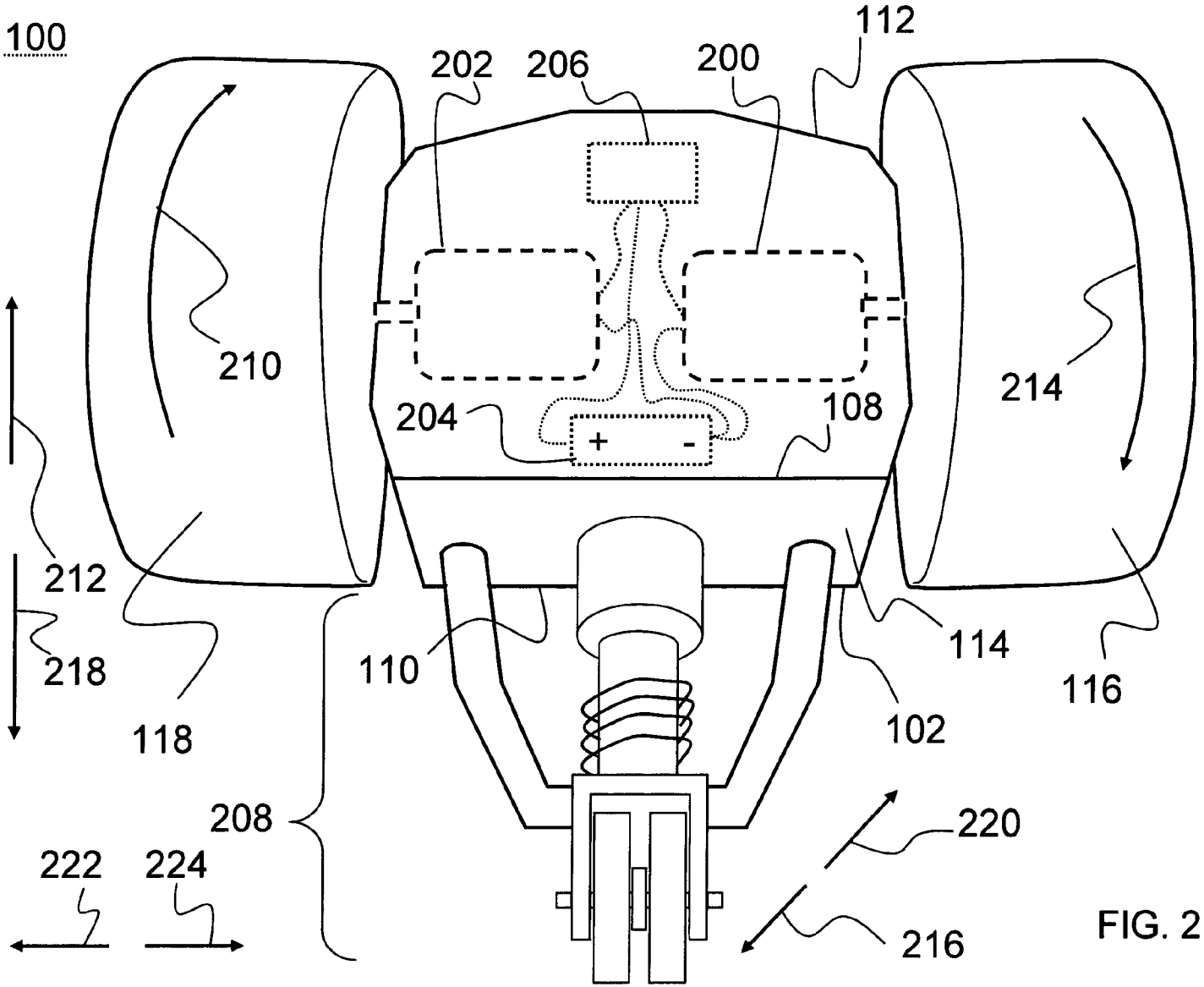
FIG. 2 is a top-view illustration of a remotely controlled vehicle according to the present invention, illustrating various exemplary internal components.

FIG. 2 illustrates a top-view of the RC vehicle 100, showing various exemplary internal components encased within the body member 102. For example, a first motor 200 is drivably coupled with the right wheel 116. Additionally, a second motor 202 is drivably coupled with the left wheel 118. The first and second motors 200 and 202 are selected from any suitable type of motor for turning a wheel, non-limiting examples of which include electric and gasoline powered motors with rotable drive shafts. In a preferred aspect, the motors 200 and 202 are electric motors connected with a battery 204. A receiver 206 is included for receiving control signals from a remotely controlled transmitter. The receiver 206 is connected with the body member 102 in any suitable location, but is desirably encased within the body member 102. The receiver 206 is connected with both the first and second motors 200 and 202, such that a control signal from the remotely controlled transmitter provides for independent control of each of the first and second motors 200 and 202 and their respective right and left wheels, 116 and 118 respectively.

A stabilization apparatus 208 is attached with the body member 102. The stabilization apparatus 208 assists in preventing the body member 102 from spinning around itself when one or both of the motors 200 and 202 are actuated. For example, when the motors 200 and 202 are actuated in a clockwise direction 210 to propel the RC vehicle 100 forward 212, a counter-clockwise force 214 is applied to the body member 102, thereby creating a tendency for the body member 102 to spin around itself. The stabilization apparatus 208 prevents this spinning by extending beyond the peripheral portions 120 of the wheels 116 and 118 and engaging with a supporting surface (e.g., ground surface). Because of the counter-clockwise force 214 of the body member 102, the stabilization apparatus 208 is forced in a downward direction 216 and against the supporting surface, thereby preventing the body member 102 from continuously spinning in place.

Additionally, by having the peripheral portions 120 of the wheels 116 and 118 extend beyond the top portion 108, bottom portion 110, and front portion 112 of the body member 102, the rear portion 114 of the body member 102 may be allowed to spin over the top portion 108 and thereby change the direction of the RC vehicle 100. For example, when the motors 200 and 202 are actuated in a counter-clockwise direction 214 to propel the RC vehicle 100 in reverse 218, an upward force 220 is applied to the stabilization apparatus 208, thereby flipping the stabilization apparatus 208 up and over to the opposite side of the RC vehicle 100 until it comes to rest against the supporting surface on the other side of the RC vehicle 100, also thereby causing the bottom portion 110 to now become the top portion 108. The operation described above enables a user to immediately change the direction of the RC vehicle 100 without the necessity to actually turn the RC vehicle 100.

Additionally, a particularly novel aspect of the present invention is that the RC vehicle 100 includes only two drive wheels, the right wheel 116 and the left wheel 118. Each of the wheels 116 and 118 are independently controlled by the receiver. By having only two drive wheels, each of which are independently controlled, the RC vehicle 100 is able to effectively turn in place, such that uni-engagement of the left 118 or right 116 wheels alone causes the RC vehicle 100 to turn, and bi-engagement of both the right 116 and left 118 wheels in opposite directions also causes the RC vehicle 100 to turn. Furthermore, bi-engagement in the same direction (i.e., either forward 210 or reverse 218) causes the remotely controlled car to propel itself forward 210 or reverse 218 (which causes the stabilization apparatus 208 to flip over the top of the RC vehicle 100 as described above), thereby allowing a user to maneuver the RC vehicle 100 in forward 210, reverse 218, left 222, and right 224 directions.

Figure 3:
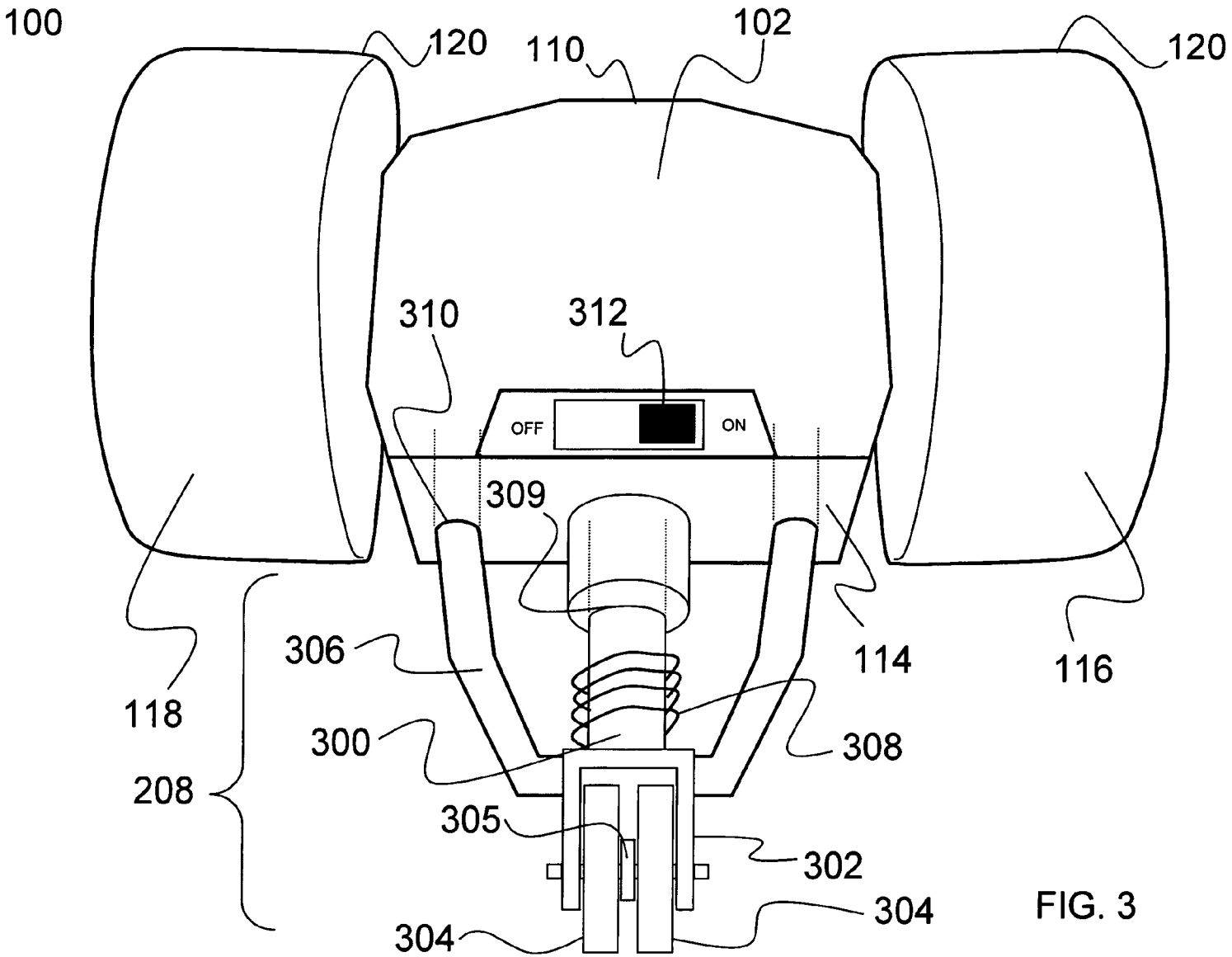
FIG. 3 is a bottom-view illustration of a remotely controlled vehicle according to the present invention.

FIG. 3 illustrates a bottom-view of the RC vehicle 100. As seen in both the top and bottom views, the stabilization apparatus 208 includes a rod 300, attached such that the stabilization apparatus 208 protrudes from the rear portion 114 of the body member 102. The rod 300 can be fixed, or be in a movable connection with the body member 102.

The rod 300 (and stabilization apparatus 208) has an outer portion 302 with at least two stabilization wheels 304 rotationally attached with the outer portion 302. A washer 305 may be included between the stabilization wheels 304 to assist the wheels in spinning. The stabilization wheels 304 allow the RC vehicle 100 to easily roll across a surface without having to drag any point of the vehicle 100. Additionally, because the RC vehicle 100 is propelled by the front two wheels only, stabilization wheels 304 in the rear enable the RC vehicle 100 to turn more easily.

Side rods 306 may also be included to prevent side-to-side sway of the rod 300. An antenna 308 is circumferentially disposed around the rod 300. The antenna 308 allows the RC vehicle 100 to pick up signals from an RC transmitter and pass the signal on to the receiver.

In another aspect, the antenna 308 can be formed to operate as a spring to force the stabilization wheel 304 away from the body member 102, thereby minimizing impact forces against the body member 102 when coming in contact with a surface. To enable the stabilization apparatus 208 to move, the body member 102 includes at least one sleeve 309. The sleeve 309 allows for insertion of the rod 300, thereby providing for a slide-able rod 300 inserted within the body member 102 and creating the movable connection. In this aspect, the side rods 206 also move within sleeves 310 formed on the body member 102.

In another aspect, not shown, the stabilization apparatus 208 may simply be an extension of the body member 102, such that the extended portion extends beyond the peripheral portions 120 of the wheels 116 and 118 to engage with the supporting surface, thereby preventing the body member 102 from spinning around itself as described above. Essentially, the stabilization apparatus 208 is any suitably rigid protrusion that is connected with the body member 102 and protrudes beyond the peripheral portions 120 of the wheels 116 and 118 proximate the rear portion. As described herein, the stabilization apparatus 208 can be an extension of the body member 102, or be another apparatus attached with the body member 102 to extend beyond the peripheral portions 120.

Also shown in FIG. 3 is an on/off switch 312. The on/off switch 312 provides for activation of the RC vehicle 100. As can be appreciated by one in the art, the on/off switch 312 is shown on the bottom portion 110 for illustrative purposes only, and can be positioned at any suitable location on the RC vehicle 100.

Figure 4:
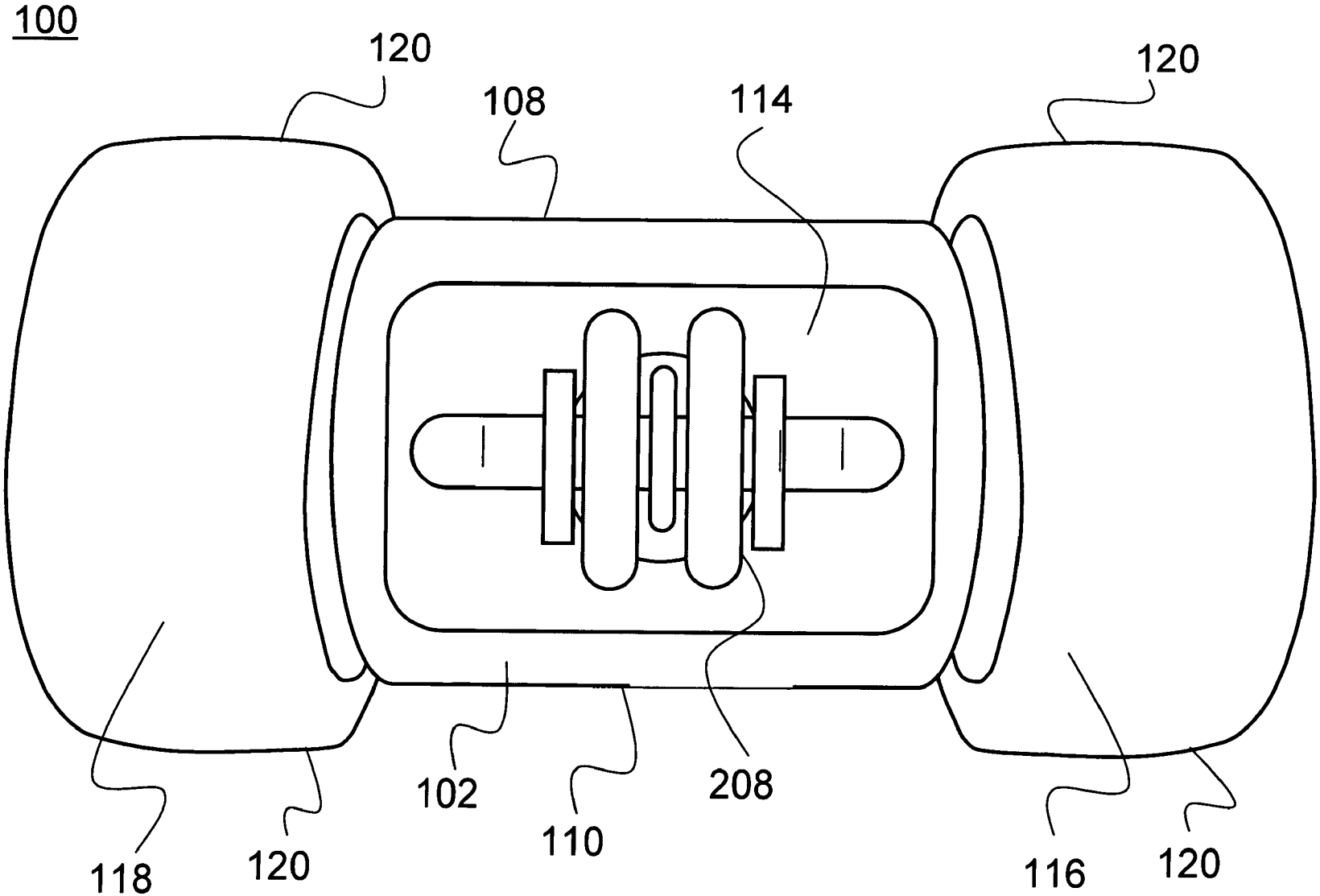
FIG. 4 is a rear-view illustration of a remotely controlled vehicle according to the present invention.

FIG. 4 is a rear-view illustration of the RC vehicle 100, showing the rear portion 114 with its respective stabilization apparatus 208. As can be seen in FIG. 4, the peripheral portions 120 of the wheels 116 and 118 extend beyond the top portion 108 and bottom portion 110 of the body member 102.

Figure 5:
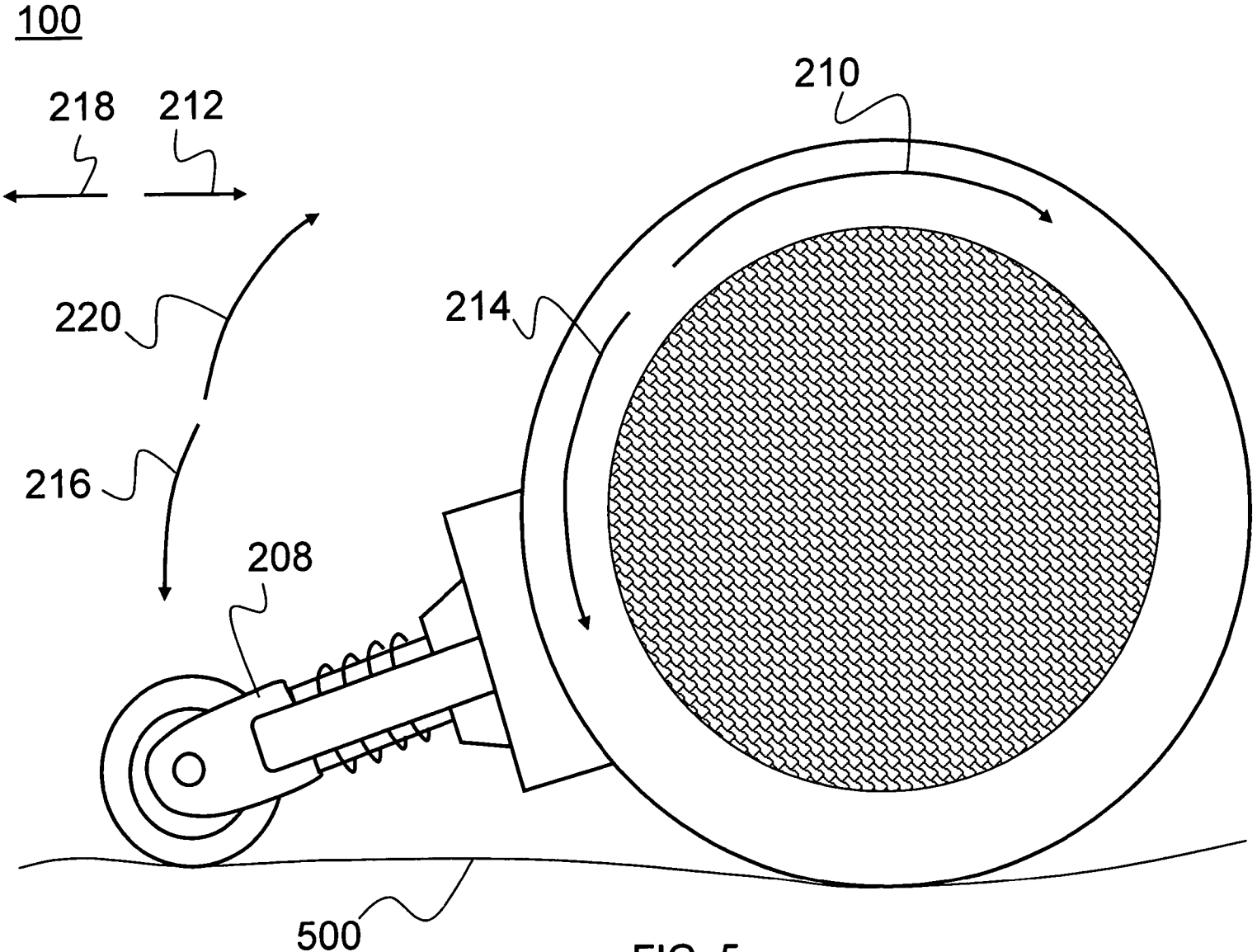
FIG. 5 is a right side-view illustration of a remotely controlled vehicle according to the present invention.
Figure 6:
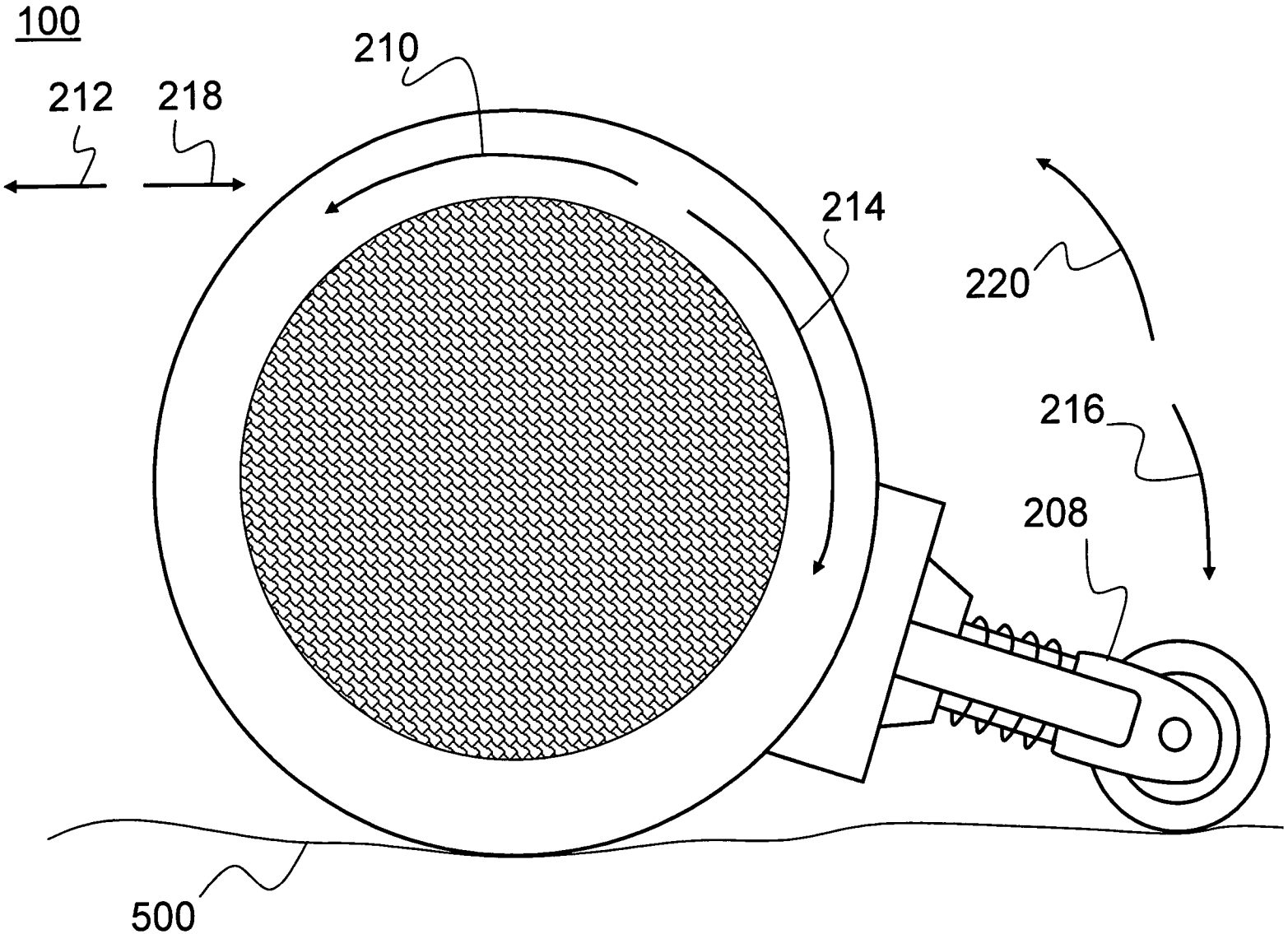
FIG. 6 is a left side-view illustration of a remotely controlled vehicle according to the present invention.

FIGS. 5 and 6 are right side-view and left side-view illustrations of the RC vehicle 100 respectively. As clearly shown in FIGS. 5 and 6, when the motors are actuated in a clockwise direction 210 to propel the RC vehicle 100 forward 212, a counter-clockwise force 214 is applied to the body member and its attached stabilization apparatus 208. Because of the counter-clockwise force 214, the stabilization apparatus 208 is forced in a downward direction 216 and against the supporting surface 500.

Additionally, when the motors are actuated in a counter-clockwise direction 214 to propel the RC vehicle 100 in reverse 218, an upward force 220 is applied to the stabilization apparatus 208, thereby flipping the stabilization apparatus 208 up and over to the opposite side of the RC vehicle 100 until it comes to rest against the supporting surface 500 on the other side of the RC vehicle 100.

Figure 7A:
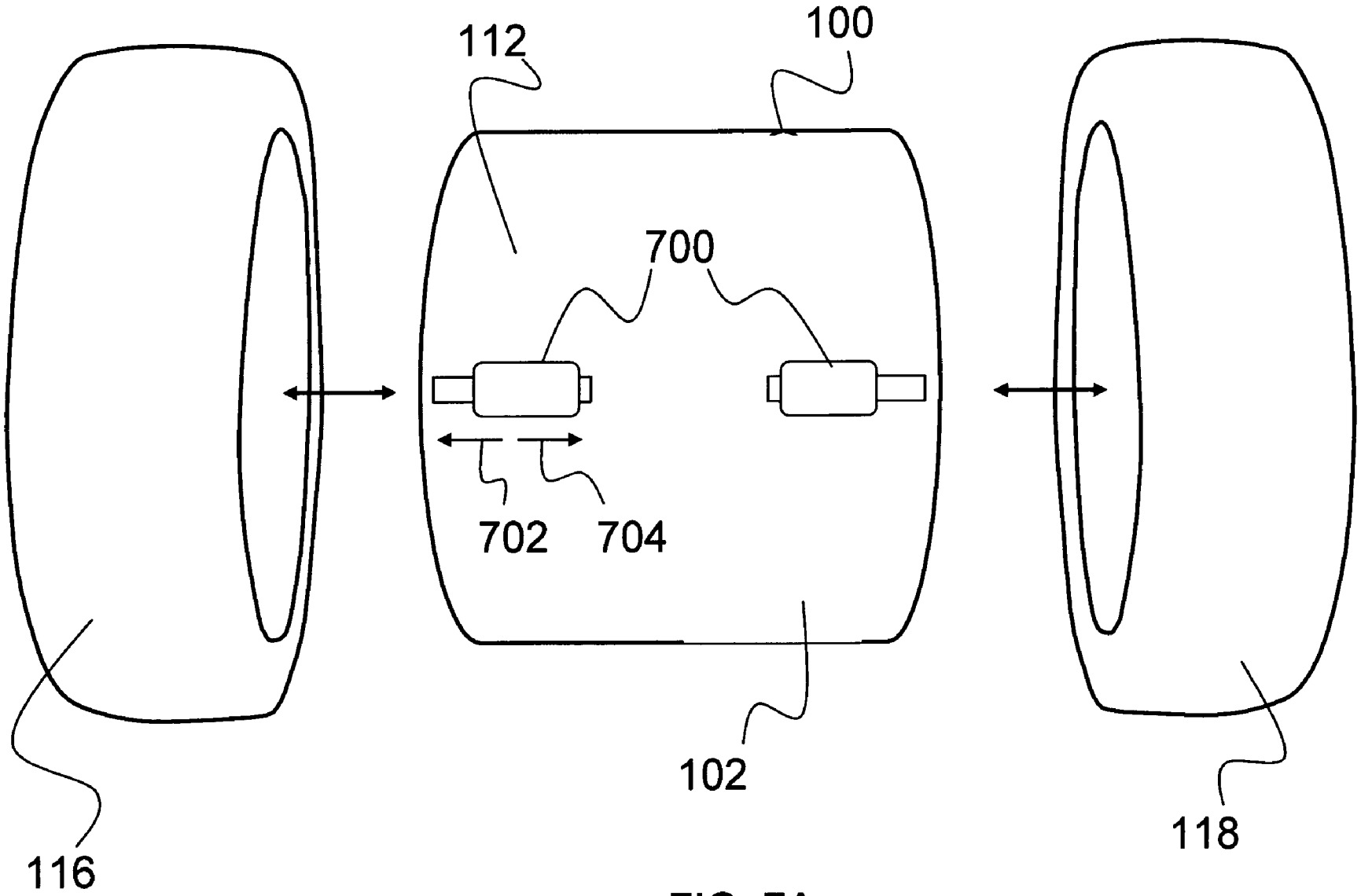
FIG. 7A is a front-view illustration of a remotely controlled vehicle according to the present invention, showing detachably-attachable interchangeable wheels.

FIG. 7A is a front-view illustration of the RC vehicle 100. Another novel aspect of the present invention is its quick-release and interchangeable wheels 116 and 118. As shown in FIG. 7A, both the right 116 and left 118 wheels are detachably attachable with the body member 102. The wheels 116 and 118 are detachably attachable through the use of a quick release apparatus 700. The quick release apparatus 700 may be any suitable quick release mechanism, non-limiting examples of which include a push button and a slide switch. For example, the quick release apparatus 700 is a slide switch which is slid from its rest position and outwards 702 toward the wheels to engage/disengage the wheels. When not in use, the slide switch springs back 704 into its rest position.

Figures 7B, 7C:
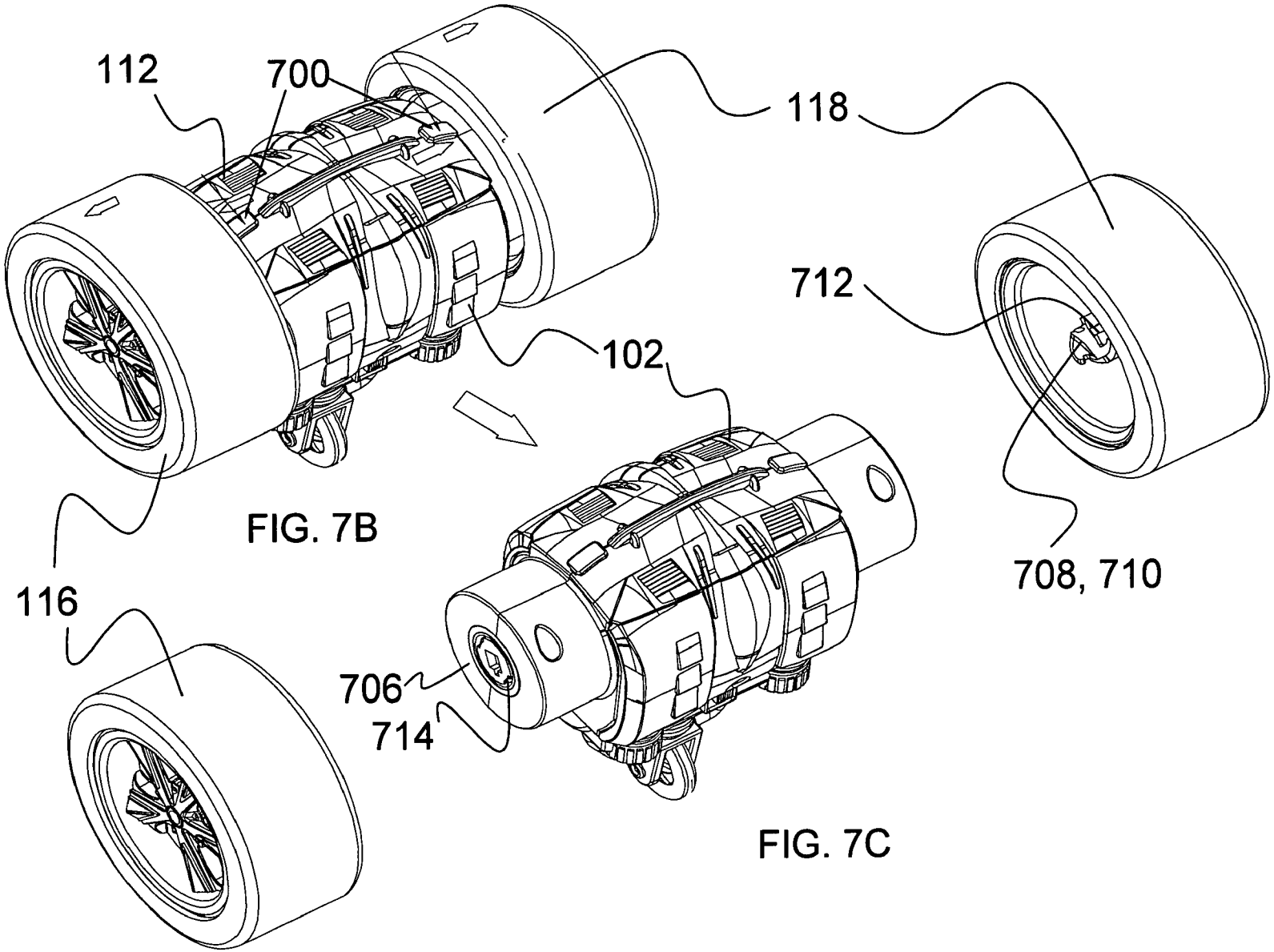
FIG. 7B is a perspective-view illustration of a remotely controlled vehicle according to the present invention, showing detachably-attachable interchangeable wheels connected with a body member.
FIG. 7C is a perspective-view illustration of a remotely controlled vehicle according to the present invention, showing the detachably-attachable wheels shown in FIG. 7B, being disconnected from the body member.

As shown in FIGS. 7B and 7C, the quick release apparatus 700 is connected with a body member attachment mechanism 706. The body member attachment mechanism 706 is attachable with the wheels 116 and 118 to hold the wheels 116 and 118 in place. Each of the wheels 116 and 118 includes a corresponding wheel attachment mechanism 708. As a non-limiting example, the wheel attachment mechanism 708 is a central rotor 710 with outer ridges 712 that are formed to be connected with the body member attachment mechanism 706. In this aspect, the body member mechanism 706 includes a space 714 for insertion of the central rotor 710, and a pin (not shown) for sliding within the outer ridges 712. The pin locks the central rotor 710 within the body member mechanism 706, thereby locking the wheels 116 and 118 with the body member 102. Actuation of the quick release apparatus 700 causes the body member attachment mechanism 706 to disengage from the wheel attachment mechanism 708 (i.e., causes the pin to disengage from the outer ridges 712), thereby releasing its corresponding wheel and allowing for placement of another interchangeable wheel.

As can be appreciated by one in the art, although the quick release apparatus 700 is shown on the front portion 112, it can be placed at any suitable location on the body member 102 to provide for ease of access and quick release of the wheels 116 and 118.

Figure 8:
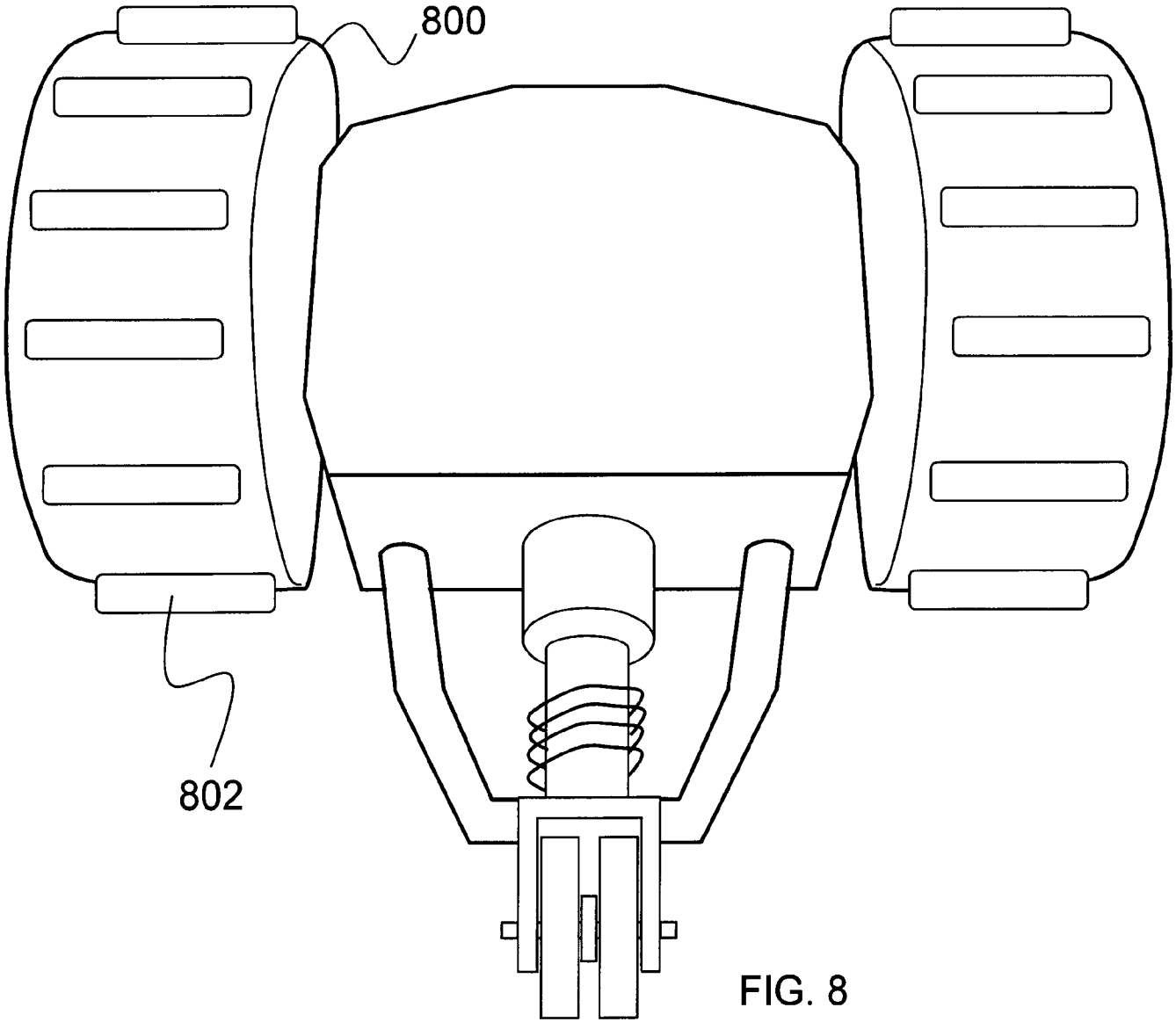
FIG. 8 is a top-view illustration of another aspect of a remotely controlled vehicle according to the present invention, showing alternate interchangeable wheels attached with the vehicle.

In addition to changing the wheels for aesthetic purposes, different interchangeable wheels provided a variety of functional differences. For example, on asphalt, a smooth wheel is appropriate, providing proper traction and speed for the RC vehicle 100. When used in mud however, the smooth wheel may spin in the loose surface. Accordingly, as shown in FIG. 8, an interchangeable wheel 800 having mud flaps 802 or other off-road tread is appropriate, thereby providing increased traction for that particular terrain. Additionally, wheels with varying diameters provide for varying speeds. As such, it may be desirable to change the wheel with another interchangeable wheel to increase or decrease the speed of the RC vehicle 100. Because of this need and desire to change the wheels 116 and 118, the wheels 116 and 118 are formed to be interchangeable with other detachably attachable wheels. As such, the wheels 116 and 118 may be formed in a variety of shapes and sizes, so long as they are detachably attachable with the body member 102.

Figures 9A, 9B:
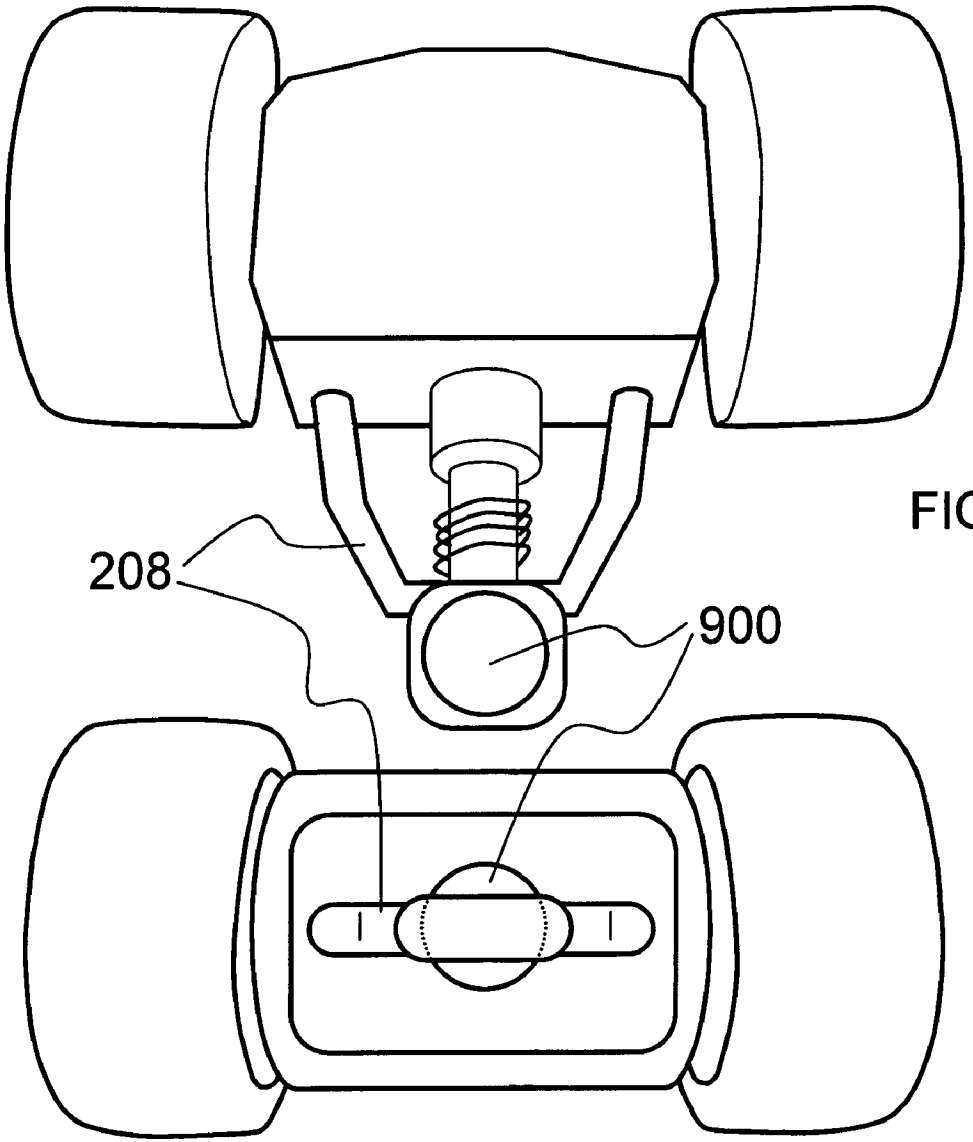
FIG. 9A is a top-view illustration of another aspect of a remotely controlled vehicle according to the present invention, illustrating a roller ball encased with the stabilization apparatus.
FIG. 9B is a rear-view of the remotely controlled vehicle of FIG. 9A.

FIGS. 9A and 9B illustrate another aspect of the present invention. As shown in FIG. 9A, instead of stabilization wheels, a roller ball 900 is encased within the stabilization apparatus 208 such that outer portions of the roller ball 900 extend beyond the stabilization apparatus 208. The roller ball 900 allows the RC vehicle 100 to roll smoothly along a surface without the use of stabilization wheels. Additionally, the roller ball 900 would be advantageous when turning, as it would create less drag than a traditional wheel. FIG. 9B illustrates a rear-view of the RC vehicle 100. As shown in FIG. 9B, the roller ball 900 extends above and below the stabilization apparatus 208 so that the stabilization apparatus 208 does not contact a surface when the RC vehicle 100 is in use.

Figure 10:
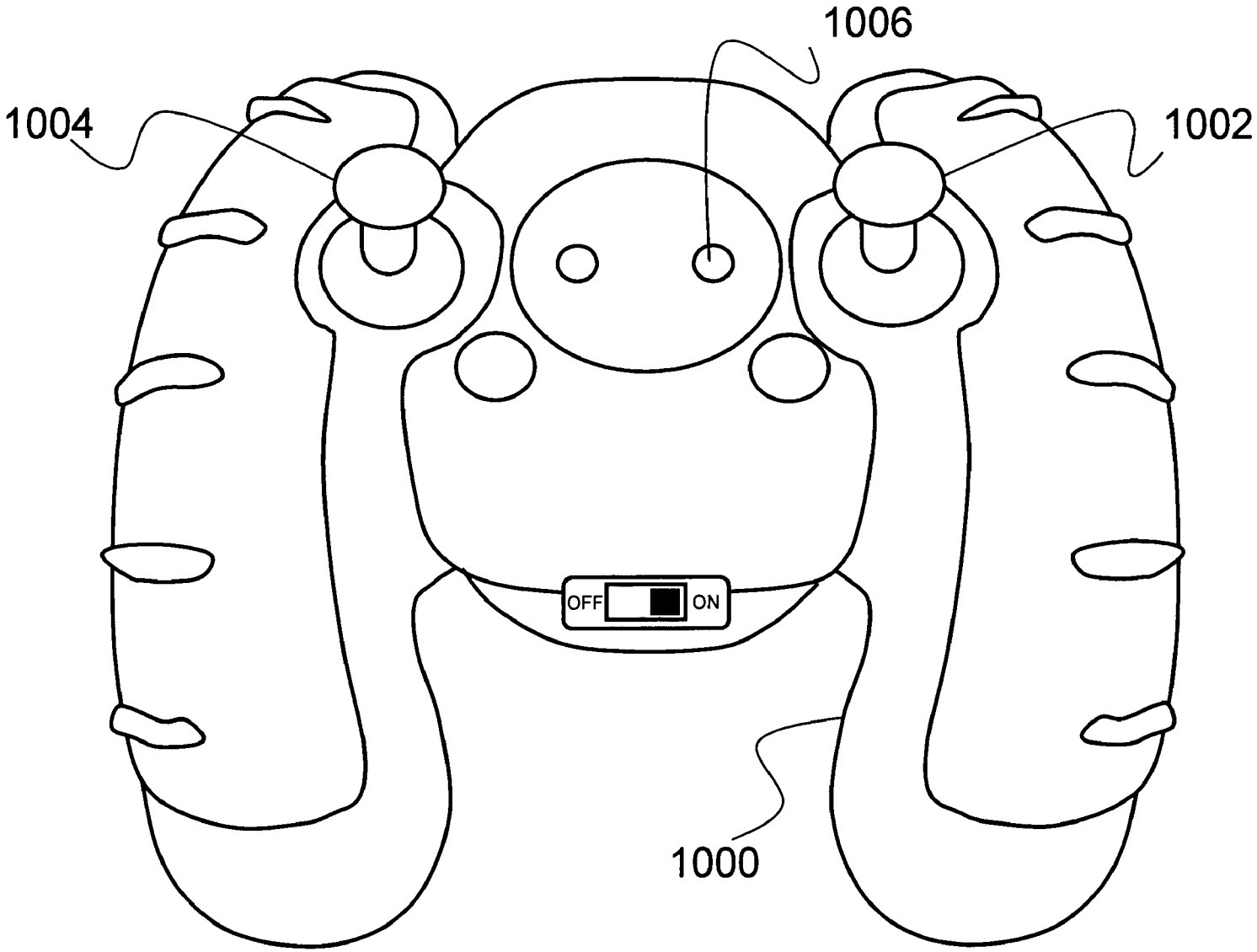
FIG. 10 is a top-view illustration of a remotely controlled according to the present invention.

As shown in FIG. 10, the present invention further includes a remotely controlled (RC) transmitter 1000 configured to transmit control signals to the receiver encased within the RC vehicle. The RC transmitter 1000 includes at least two controllers, a first controller 1002 and a second controller 1004. The controllers 1002 and 1004 are any suitable switches for actuating the transmission of the control signals. The first controller 1002 is configured to control the first motor and its corresponding right wheel, while the second controller 1004 is configured to control the second motor and its corresponding left wheel. Through use of the RC transmitter 1000, a user may control the RC vehicle and cause it to go in forward, reverse, left, and right directions. A light emitting diode (LED) 1006 may also be included with the RC transmitter 1000. The LED 1006 is illuminated when the RC transmitter 1000 is turned to an "on" position, and is turned off when the RC transmitter is turned to an "off" position.

As can be appreciated by one skilled in the art, the present invention also comprises a method for forming the remotely controlled vehicle described herein. The method includes acts of forming a body member 102; rotationally mounting a detachably attachable right wheel 116 proximate the right portion of the body member 102; drivably coupling a first motor 200 with the right wheel 116; rotationally mounting a detachably attachable left wheel 118 proximate the left portion of the body member 102; drivably coupling a second motor 202 with the left wheel 118; attaching a receiver 206 with the body member 102; and attaching a stabilization apparatus 208 with the body member 102.

(2.2) Detailed Description of the Launcher

Figure 11:
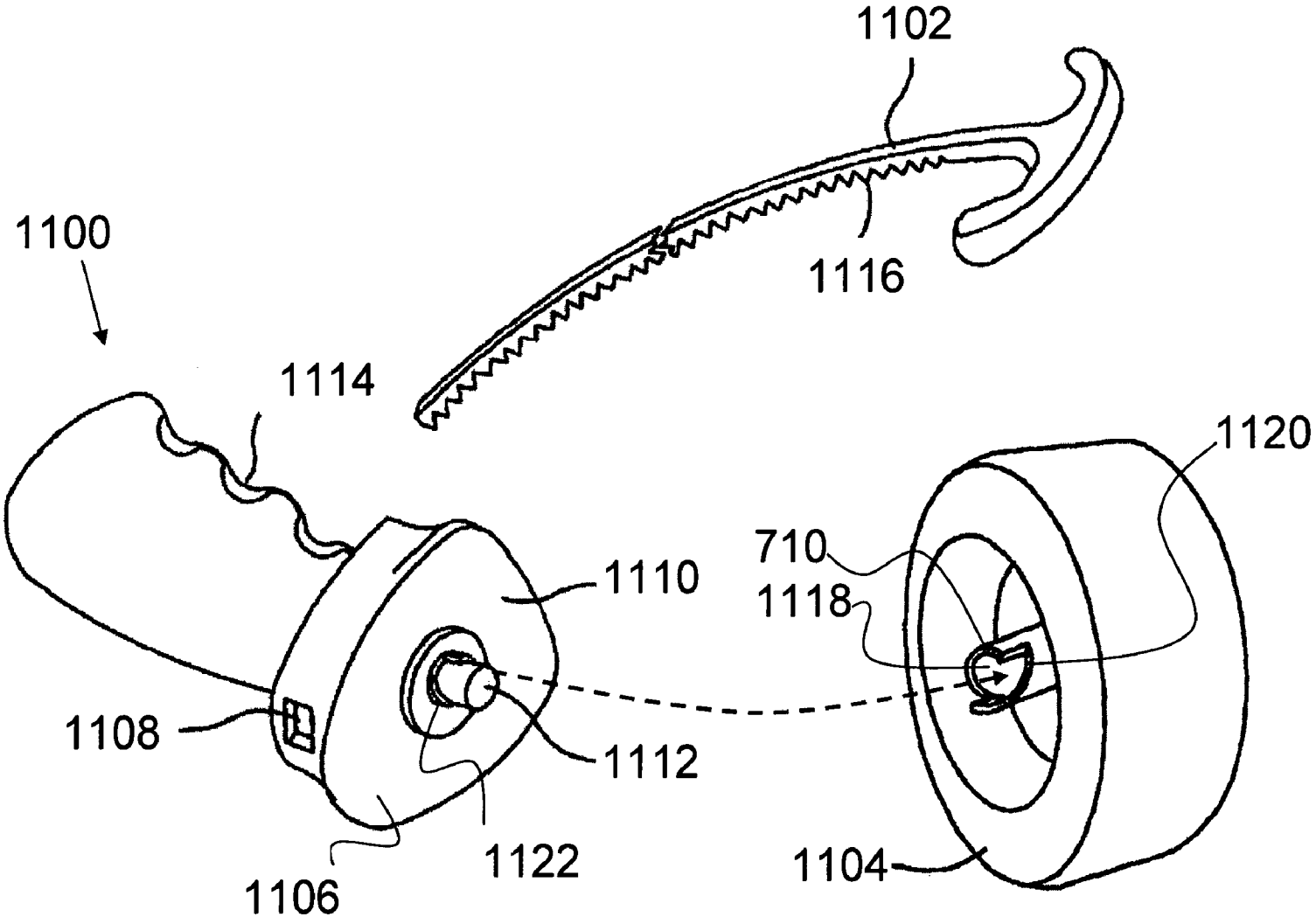
FIG. 11 is a perspective-view illustration of a detachably attachable wheel, a launcher, and a strip for use with the launcher, according to the present invention.

As noted above, the wheels 116 and 118 described herein are detachably attachable. Because of their detachability, the wheels can also be used in other devices. Accordingly, the present invention also includes a launcher to launch the detachably attachable wheels. As shown in FIG. 11, the present invention also comprises a launcher 1100 and a strip 1102 for launching the interchangeable wheels 116 and 118 (hereinafter referred to individually as a "detachably attachable wheel 1104").

The launcher 1100 has a housing 1106 with an opening 1108 passing through the housing 1106. The housing 1106 also includes a top surface 1111 on which a rotating end 1112 protrudes. A handle 1114 is included to allow a user to securely grasp the launcher 1100.

The strip 1102 (i.e., ripcord) has teeth 1116 on one side of its longitudinally extending strip like surface. The strip 1102 is formed to be passed through the opening 1108 in the housing 1106 and engage with gears therein.

The detachably attachable wheel 1104 includes a central rotor 711 that is formed to be attached with the rotating end 1112. As a non-limiting example, the central rotor 711 includes a hollow space 1118 for placement of the rotating end 1112 therein. Additionally, a wheel engagement apparatus 1120 is formed to engage with a corresponding rotating-end engagement apparatus 1122, such that as the rotating end 1112 rotates, the rotating-end engagement apparatus 1122 engages with the wheel engagement apparatus 1120 to cause the detachably attachable wheel 1104 to spin.

Figure 12:
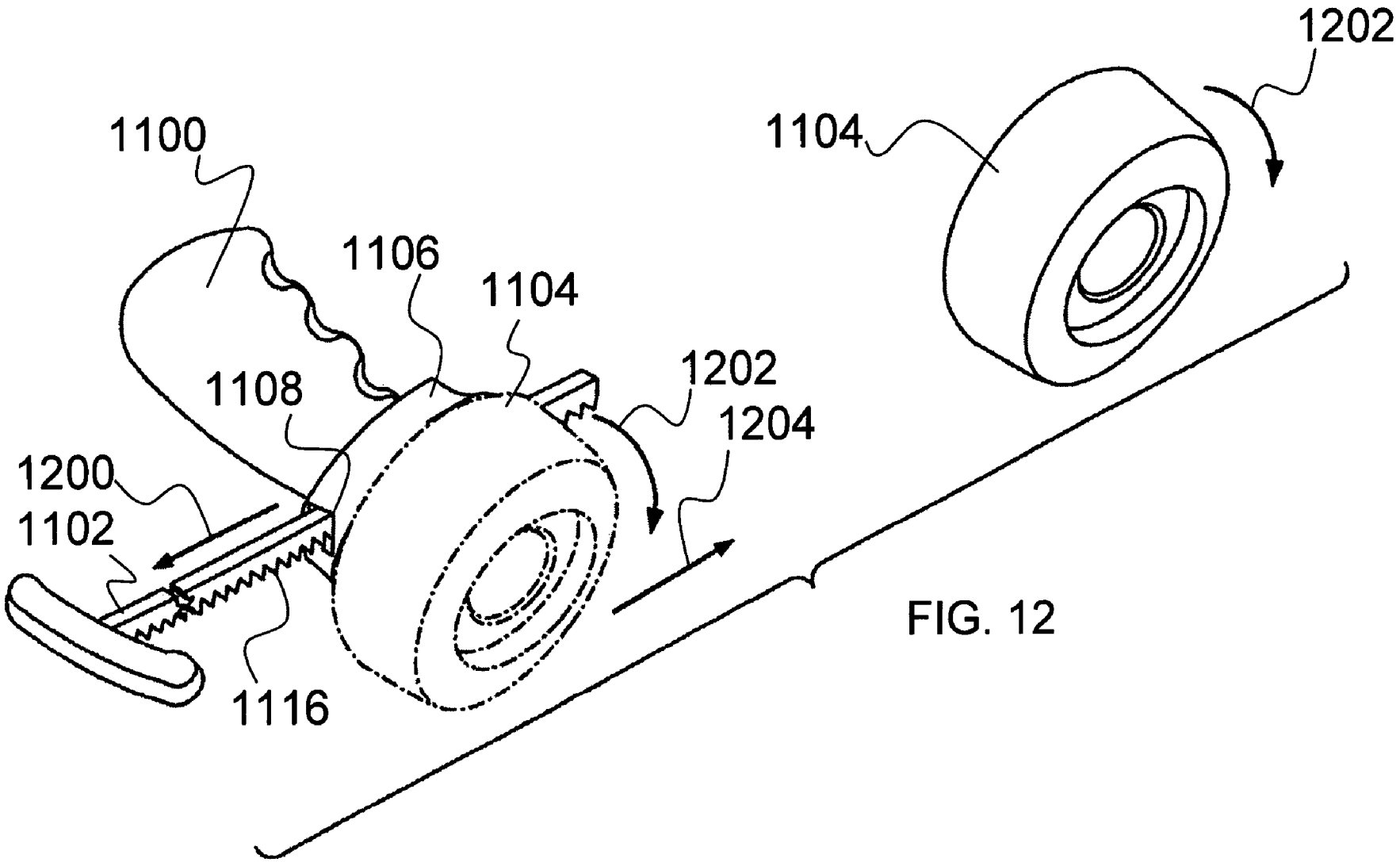
FIG. 12 is a perspective-view illustration, illustrating how the detachably attachable wheel is launched and showing a launched detachably attachable wheel (in dashed lines)

FIG. 12 illustrates the detachably attachable wheel 1104 being launched from the launcher 1100. The teeth 1116 of the strip 1102 engages with teeth on the gears (inside the housing) when the strip 1102 is inserted through the opening 1108 and into the launcher 1100 housing 1106. When the strip 1102 is pulled out 1200 of the housing 1106 it causes the gears (inside the housing) to rotate the rotating end, with the rotating end engaging with and rotating the central rotor of the detachably attachable wheel 1104 so that the wheel 1104 spins 1202 and is launched from the launcher 1100 housing 1106. After being launched from the launcher 1100, the detachably attachable wheel 1104 spins away 1204 from the launcher 1100.

Figure 13A:
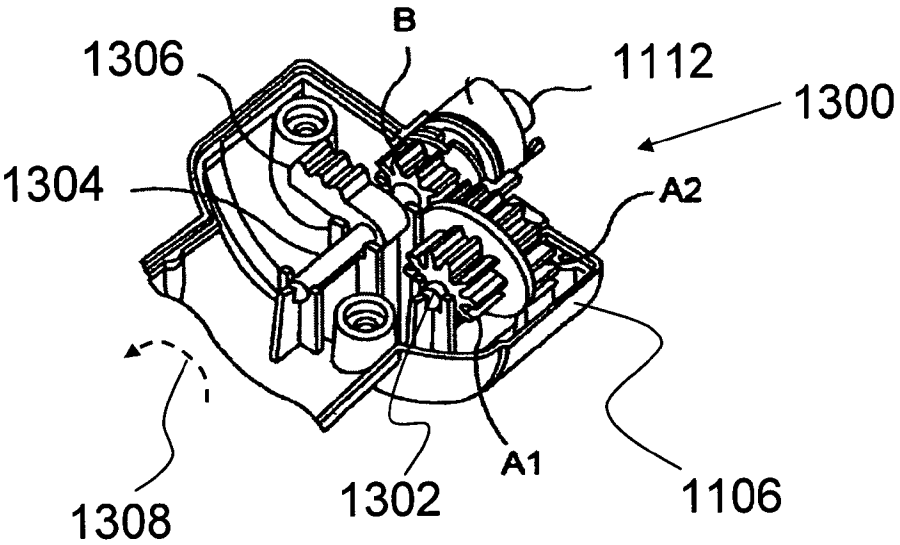
FIG. 13A is a top-view illustration of a gear system inside the launcher housing, according to the present invention.
Figure 13B:
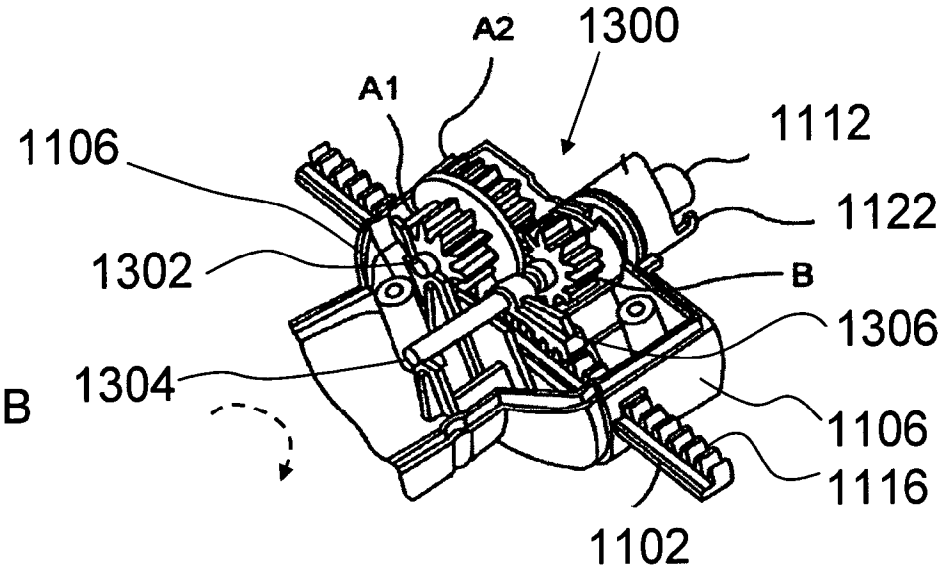
FIG. 13B is a bottom-view illustration of a gear system inside the launcher housing, according to the present invention.

FIGS. 13A and 13B illustrate top and bottom-views respectively of a gear system 1300 inside the launcher housing 1106. As shown in FIGS. 13A and 13B, the inside of the housing 1106 includes a plurality of gears. In operation, the strip 1102 is inserted through the opening 1108 of the housing 1106 and into the gear system 1300. The teeth 1116 of the strip 1102 engage with the teeth on the gear A1. Working on the same axle 1302, the strip 1102 drives the combination of gears A1 and A2. The rotating end 1113 and Gear B work together on the same axle 1304, such that the rotating end 1113 rotates in the same direction as Gear B when Gear B is rotated.

Both the rotating end 1113 and Gear B's rotation is slow when the strip 1102 is slowly inserted into the housing 1106. When the strip 1102 is pulled from the housing 1106, all the gears in the gear system 1300 work. When the strip 1102 is pulled from the housing 1106, Gears A1 and A2 rotate. Gear A2 drives Gear B, which causes the rotating end 1113 to rotate. The gears will continue to rotate as the strip 1102 is pulled out of the housing 1106 and away from the gear system 1300. As the gears rotate, the rotating-end engagement apparatus 1122 causes the detachably attachable wheel to spin off of the rotating end 1113 and away from the housing 1106.

Additionally, a wheel engagement apparatus 1120 is formed to engage with a corresponding rotating-end engagement apparatus 1122, such that as the rotating end 1113 rotates, the rotating-end engagement apparatus 1122 engages with the wheel engagement apparatus 1120 to cause the detachably attachable wheel 1104 to spin.

FIG. 13A illustrates the correct position to operate the invention. A user holds the launcher 1110 in the user's left hand and pulls the strip with the user's right hand. In such a configuration, the strip passes along a top side of the gear system 1300. When held in the position shown in FIG. 13A, a stopper 1306 falls back and away 1308 from an inserted strip, allowing the strip to slide freely through the housing 1106. As can be appreciated by one skilled in the art, although the description is related to right-handed users, it is not intended to be limited thereto. As such, the gear system 1300 and other relevant parts of the launcher 1110 can be formed in a reverse manner to accommodate left-handed users.

Alternatively and as shown in FIG. 13B, when the housing 1106 is flipped over, the stopper 1306 will fall down 1311 to engage with the strip 1102. Through use of the stopper 1306, the strip 1102 can only be inserted into the housing 1106 from one direction, thereby only allowing a user to launch the wheel away from the user.

Figures 14A, 14B:
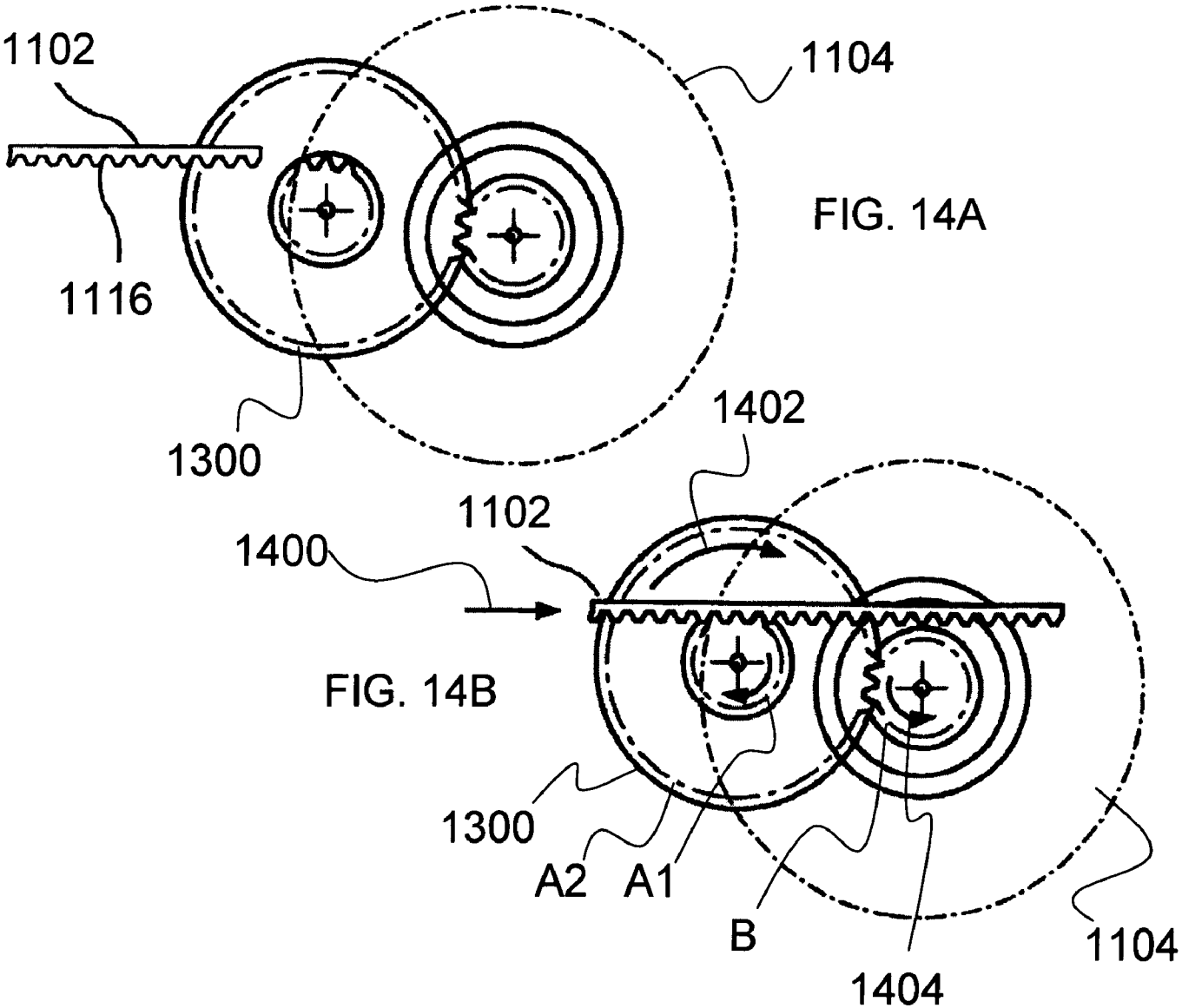
FIG. 14A is an illustration showing the gear system in operation, where a strip is being inserted into the launcher housing.
FIG. 14B is an illustration showing the gear system in operation, where the strip is fully inserted into the launcher housing.
Figures 14C, 14D:
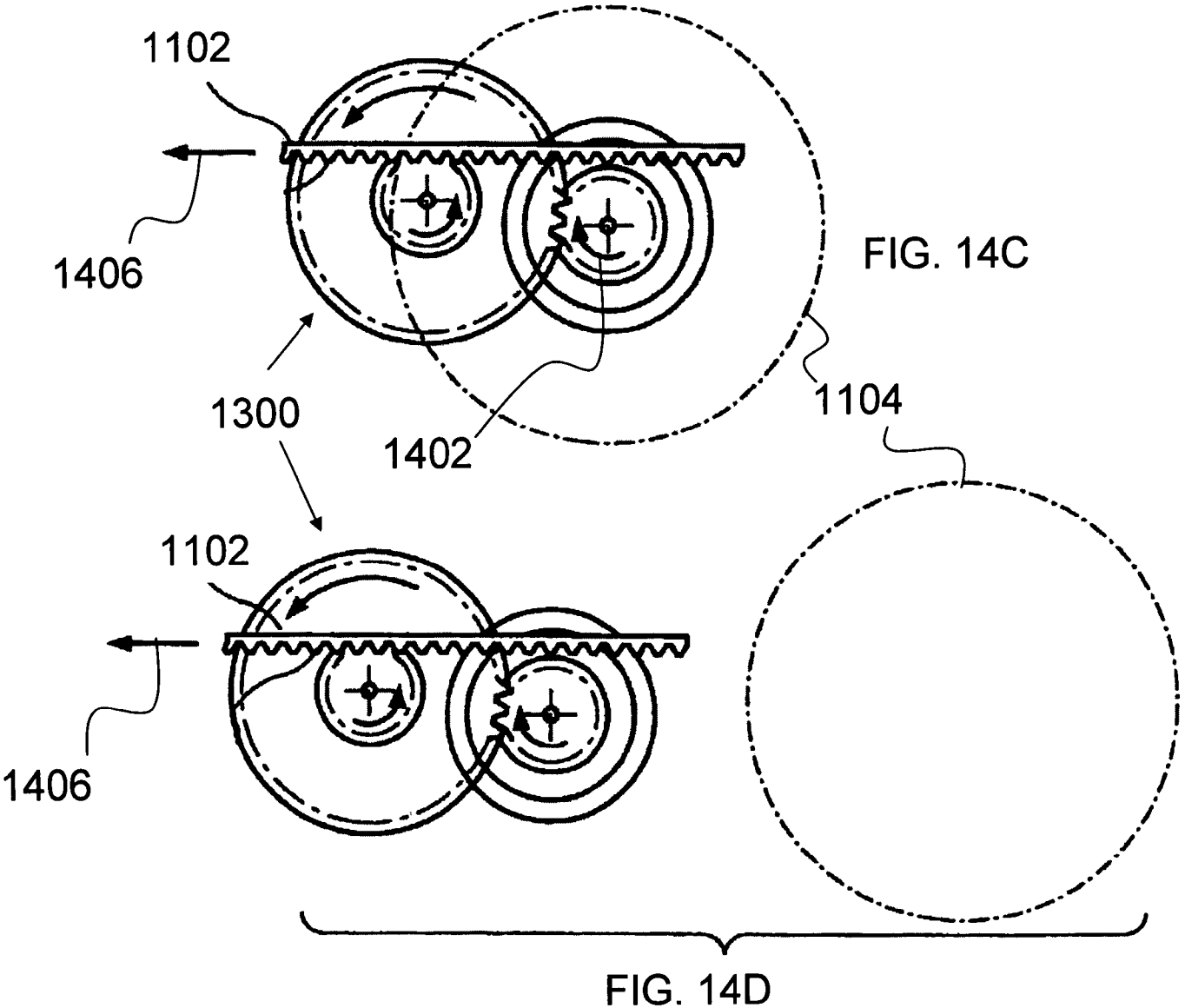
FIG. 14C is an illustration showing the gear system in operation, where the strip is being removed from the launcher housing and causing the detachably attachable wheel to begin spinning.
FIG. 14D is an illustration showing the gear system in operation, where the strip is pulled through the launcher housing and the detachably attachable wheel is spinning and fully launched (in dashed lines).

For further clarification, FIGS. 14A through 14D illustrate the launcher gear system in operation. FIG. 14A illustrates the strip 1102 with teeth 1116 being introduced to the gear system 1300. Through its plurality of gears, the gear system 1300 is attached with the detachably attachable wheel 1104. As shown in FIG. 14B, as the strip 1102 is inserted 1400 into to the gear system 1300, Gears A1 and A2 turn in a first direction 1402, while Gear B turns in a second direction 1404. FIG. 14C illustrates the strip 1102 being removed 1406 from the launcher, thereby causing the gear system 1300 to rotate the detachably attachable wheel 1104 in the first direction 1402. Finally, FIG. 14D illustrates the strip 1102 being pulled through the gear system 1300 to cause the detachably attachable wheel 1104 to launch and spin away from the launcher.

It should be noted that the gear system described herein references a specific gear configuration for illustrative purposes only, and that it is not intended to be limited thereto. As can be appreciated by one in the art, there are many gear system configurations that can be utilized to cause the detachably attachable wheel to spin away from the launcher.

What is claimed is:

1. A remotely controlled vehicle, comprising:

a body member having a left portion, a right portion, a top portion, a bottom portion, a front portion, and a rear portion;

a quick release mechanism connected with the body member;

a detachably attachable right wheel having a wheel attachment mechamism, the right wheel rotationally mounted proximate the right portion of the body member for rotationally supporting the body member on a supporting surface, the right wheel having dimensions and a peripheral portion such that the peripheral portion of the right wheel extends beyond the top, bottom, and front portions of the body member, the detachably attachable right wheel being detachably attachable with the body member through use of the quick release mechanism;

a first motor drivably coupled with the right wheel;

a detachably attachable left wheel having a wheel attachment mechanism, the left wheel rotationally mounted proximate the left portion of the body member for rotationally supporting the body member on the supporting surface, the left wheel having dimensions and a peripheral portion such that the peripheral portion of the left wheel extends beyond the top, bottom, and front portions of the body member, the detachably attachable left wheel being detachably attachable with the body member through use of the quick release mechanism;

a second motor drivably coupled with the left wheel;

a receiver attached with the body member for receiving control signals from a remotely controlled transmitter, the receiver being independently connected with both the first and second motors such that a control signal from the remotely controlled transmitter provides for independent control of each of the first and second motors and their respective right and left wheels; and a stabilization apparatus attached with the body member such that when the wheels are engaged, the stabilization apparatus is forced against the supporting surface, thereby preventing the body member from continuously spinning in place;

wherein the body member further has a left body member attachment mechanism and a right body member attachment mechanism, and wherein the quick release mechanism is operably connected with at least one of the body member attachment mechanisms;

wherein each body member attachment mechanism is formed to selectively connect with and lock a wheel attachment mechanism against the body member attachment mechanism, such that when a wheel and its corresponding wheel attachment mechanism are locked in place against the body member attachment mechanism, actuation of the quick release mechanism causes the body member attachment mechanism to disengage from the wheel attachment mechanism and thereby release the wheel;

wherein the wheel attachment mechanism is a central rotor with outer ridges formed to be connected with the body member attachment mechanism, the body member attachment mechanism including a space for insertion of the central rotor and a pin for sliding within the outer ridges, such that the pin locks the central rotor within the body member attachment mechanism, thereby locking the wheel with the body member, and wherein actuation of the quick release apparatus causes the pin to disengage from the outer ridges and thereby release the wheel whereby through use of a remotely controlled transmitter, a user can independently control each of the right and left wheels, such that uni-engagement of the left or right wheels alone causes the remotely controlled vehicle to turn, and bi-engagement of both the right and left wheels in opposite directions also causes the remotely controlled vehicle to turn, while bi-engagement in the same direction causes the remotely controlled vehicle to propel itself forward, thereby allowing a user to maneuver the remotely controlled vehicle in forward, reverse, left, and right directions.

2. A remotely controlled vehicle as set forth in claim 1, wherein the wheels are detachably attachable with the body member through the use of a quick release apparatus, such that actuation of the quick release apparatus releases at least one wheel, allowing for placement of another interchangeable wheel.

3. A remotely controlled vehicle as set forth in claim 2, wherein both the first and second motors are encased within the body member.

4. A remotely controlled vehicle as set forth in claim 3, wherein the body member is formed such that it is water resistant, thereby protecting the remotely controlled vehicle from aqueous elements.

5. A remotely controlled vehicle as set forth in claim 4, further comprising a remotely controlled transmitter configured to transmit control signals to the receiver, the remotely controlled transmitter having a first controller and a second controller, where the first controller is configured to control the first motor and its corresponding right wheel, and where the second controller is configured to control the second motor and its corresponding left wheel.

6. A remotely controlled vehicle as set forth in claim 5, wherein the stabilization apparatus includes a rod connected with the body member, the rod having an outer portion and at least two stabilization wheels rotationally attached with the outer portion, such that in operation, the remotely controlled vehicle rests upon the left wheel, right wheel, and stabilization wheels.

7. A remotely controlled vehicle as set forth in claim 6, wherein the rod is in a movable connection with the body member.

8. A remotely controlled vehicle as set forth in claim 7, further comprising an antenna circumferentially disposed around the rod.

9. A remotely controlled vehicle as set forth in claim 8, wherein the antenna is formed to operate as a spring to force the stabilization wheel away from the body member, thereby minimizing impact forces against the body member when coming in contact with a surface.

10. A remotely controlled vehicle as set forth in claim 9, wherein the rod is in the movable connection with the body member such that the body member includes at least one sleeve, with the rod inserted within sleeve, thereby providing for a slide-able rod inserted within the body member and creating the movable connection.

11. A remotely controlled vehicle as set forth in claim 10, wherein the stabilization apparatus is attached proximate the rear portion of the body member.

12. A remotely controlled vehicle as set forth in claim 11, wherein each detachably attachable wheel includes a central rotor.

13. A remotely controlled vehicle as set forth in claim 12, wherein the detachably attachable wheel is formed to be used with a device other than a remotely controlled vehicle.

14. A remotely controlled vehicle as set forth in claim 1, wherein both the first and second motors are encased within the body member.

15. A remotely controlled vehicle as set forth in claim 1, wherein the body member is formed such that it is water resistant, thereby protecting the remotely controlled vehicle from aqueous elements.

16. A remotely controlled vehicle as set forth in claim 1, further comprising a remotely controlled transmitter configured to transmit control signals to the receiver, the remotely controlled transmitter having a first controller and a second controller, where the first controller is configured to control the first motor and its corresponding right wheel, and where the second controller is configured to control the second motor and its corresponding left wheel.

17. A remotely controlled vehicle as set forth in claim 1, wherein the stabilization apparatus includes a rod connected with the body member, the rod having an outer portion and at least two stabilization wheels rotationally attached with the outer portion, such that in operation, the remotely controlled vehicle rests upon the left wheel, right wheel, and stabilization wheels.

18. A remotely controlled vehicle as set forth in claim 17, wherein the rod is in a movable connection with the body member.

19. A remotely controlled vehicle as set forth in claim 18, wherein the rod is in the movable connection with the body member such that the body member includes at least one sleeve, with the rod inserted within sleeve, thereby providing for a slide-able rod inserted within the body member and creating the movable connection.

20. A remotely controlled vehicle as set forth in claim 1, further comprising an antenna circumferentially disposed around the rod.

21. A remotely controlled vehicle as set forth in claim 20, wherein the antenna is formed to operate as a spring to force the stabilization wheel away from the body member, thereby minimizing impact forces against the body member when coming in contact with a surface.

22. A remotely controlled vehicle as set forth in claim 1, wherein the stabilization apparatus is attached proximate the rear portion of the body member.

23. A remotely controlled vehicle as set forth in claim 1, wherein each detachably attachable wheel includes a central rotor.

24. A remotely controlled vehicle as set forth in claim 1, wherein the detachably attachable wheel is formed to be used with a device other than a remotely controlled vehicle.

25. A method for forming a remotely controlled vehicle, the method comprising acts of:

forming a body member to have a left portion, a right portion, a top portion, a bottom portion, a front portion, a rear portion, and a quick release mechanism connected with the body member;

rotationally mounting a detachably attachable right wheel having a wheel attachment mechanism, the right wheel proximate the right portion of the body member for rotationally supporting the body member on a supporting surface, the right wheel having dimensions and a peripheral portion such that the peripheral portion of the right wheel extends beyond the top, bottom, and front portions of the body member, the detachably attachable right wheel being detachably attachable with the body member through use of the quick release mechanism;

drivably coupling a first motor with the right wheel;

rotationally mounting a detachably attachable left wheel having a wheel attachment mechanism, the left wheel proximate the left portion of the body member for rotationally supporting the body member on the supporting surface, the left wheel having dimensions and a peripheral portion such that the peripheral portion of the left wheel extends beyond the top, bottom, and front portions of the body member, the detachably attachable left wheel being detachably attachable with the body member through use of the quick release mechanism;

drivably coupling a second motor with the left wheel;

attaching a receiver with the body member for receiving control signals from a remotely controlled transmitter, the receiver being independently connected with both the first and second motors such that a control signal from the remotely controlled transmitter provides for independent control of each of the first and second motors and their respective right and left wheels; and attaching a stabilization apparatus with the body member such that when the wheels are engaged, the stabilization apparatus is forced against the supporting surface, thereby preventing the body member from continuously spinning in place;

wherein the body member further has a left body member attachment mechanism and a right body member attachment mechanism, and wherein the quick release mechanism is operably connected with at least one of the body member attachment mechanisms;

wherein each body member attachment mechanism is formed to selectively connect with and lock a wheel attachment mechanism against the body member attachment mechanism, such that when a wheel and its corresponding wheel attachment mechanism are locked in place against the body member attachment mechanism, actuation of the quick release mechanism causes the body member attachment mechanism to disengage from the wheel attachment mechanism and thereby release the wheel;

wherein the wheel attachment mechanism is a central rotor with outer ridges formed to be connected with the body member attachment mechanism, the body member attachment mechanism including a space for insertion of the central rotor and a pin for sliding within the outer ridges, such that the pin locks the central rotor within the body member attachment mechanism, thereby locking the wheel with the body member, and wherein actuation of the quick release apparatus causes the pin to disengage from the outer ridges and thereby release the wheel;

whereby through use of a remotely controlled transmitter, a user can independently control each of the right and left wheels, such that uni-engagement of the left or right wheels alone causes the remotely controlled vehicle to turn, and bi-engagement of both the right and left wheels in opposite directions also causes the remotely controlled vehicle to turn, while bi-engagement in the same direction causes the remotely controlled vehicle to propel itself forward, thereby allowing a user to maneuver the remotely controlled vehicle in forward, reverse, left, and right directions.

* * * * *